US005758364A

United States Patent [19]

Rewoldt

[11] Patent Number: 5,758,364

[45] Date of Patent: Jun. 2, 1998

[54] EQUIPMENT FOR ENGAGING SNOWMOBILE THROTTLE AND METHOD OF USE THEREFOR

[76] Inventor: F. John Rewoldt, Rte. 1 Box 47, Huxley, Iowa 50124

[21] Appl. No.: 582,123

[22] Filed: Jan. 2, 1996

[51] Int. Cl.[6] ..... A41D 19/00

[52] U.S. Cl. ..... 2/160; 2/161.1

[58] Field of Search ..... 2/163, 160, 161.1; 441/57

[56] References Cited

U.S. PATENT DOCUMENTS

| | | | |
|---|---|---|---|
| D. 363,153 | 10/1995 | Brasseur | 2/161.1 |
| 2,231,204 | 2/1941 | Turner | 2/163 |
| 2,304,010 | 12/1942 | Myers | 441/57 |
| 2,980,925 | 4/1961 | Wolshin | 441/57 |
| 3,231,910 | 2/1966 | Tegland | 441/57 |
| 4,121,312 | 10/1978 | Penney | 441/57 |
| 4,618,328 | 10/1986 | Chi | 441/57 |
| 5,488,739 | 2/1996 | Cardinal | 2/161.1 |

*Primary Examiner*—Bibhu Mohanty
*Attorney, Agent, or Firm*—Dana Rewoldt

[57] ABSTRACT

The present field of the invention is related to the operation of snowmobiles. More specifically, the invention is related to equipment used by a snowmobiler when operating a snowmobile. Specifically, the present invention relates to a glove adapted to engage the throttle of the snowmobile and a method of use therefore.

13 Claims, 7 Drawing Sheets

EQUIPMENT FOR ENGAGING SNOWMOBILE THROTTLE AND METHOD OF USE THEREFOR

FIELD OF THE INVENTION

The present field of the invention is related to the operation of snowmobiles. More specifically, the invention is related to equipment used by a snowmobiler when operating a snowmobile. Specifically, the present invention relates to a glove adapted to engage the throttle of the snowmobile.

BACKGROUND OF THE INVENTION

A variety of different types of recreational vehicles have been developed and are used by sports enthusiasts. Recreational vehicles include vehicles such as boats, airplanes, gliders, motorcycles, ATVs, snowmobiles and the like. Different environments are used for different recreational vehicles. Specifically, in water environments, recreational vehicles are boats or jet skis; in air environments the recreational vehicles are hang gliders or airplanes; in sand the recreational vehicles are dune buggies or ATVs; and in snow environments the recreational vehicle of choice is usually a snowmobile.

At least since the early 1960's snowmobiles have been used by sports enthusiasts in winter environments. Snowmobiles can travel on snow by the use of two front skis and a track somewhat similar to a tank track which runs from the back of the skis to the back of the snowmobile. The track is used to propel the snowmobile forward in the snow and the skis are used to change the direction of the snowmobile. Traditionally, snowmobiles have had a handlebar type steering mechanism instead of a steering wheel type steering mechanism. Usually on the snowmobile driver's righthand side when he is seated in the snowmobile seat is the throttle and on his left hand side is the brake. The right hand side of the handlebar usually has a handle grip adapted for engagement with the glove of the snowmobiler and a throttle which is adapted to be depressed to accelerate the snowmobile. The thumb of the driver's right hand engages the throttle. The left hand side of the handlebar can likewise have a brake which extends upwardly and is adapted to be depressed by the thumb or alternatively it can have a brake that extends parallel to the handlebar grip directly opposite the snowmobiler. Because the snowmobile is driven in a cold environment, the snowmobile operator is often wearing thick, heavy gloves. This additional padding around the fingers and the thumb of the snowmobiler can make operation of the throttle or the brake of the snowmobile slightly awkward. Furthermore, operation of the throttle with the thumb requires substantial muscle strength in the thumb. Snowmobile operators which are not accustomed to operating snowmobiles often have tired muscles in their hands, fingers, especially the thumb, and wrist due to consistently maintaining the hand in a position to depress the throttle. This muscle discomfort is increased by the fact that the snowmobile operator must manipulate not only his thumb but the glove that is covering his thumb, which is often formed of a material such as leather which stiffens in the cold. There is a need to provide a glove that is adapted to engage the throttle of the snowmobile without unduly tiring the muscles in the hand of the snowmobiler. Likewise, there is a need for a glove that is adapted to engage a snowmobile throttle which does not readily disengage the throttle when the snowmobile proceeds over bumps such as can often happen when the thumb portion of a snowmobile operator's glove is placed on the throttle of the snowmobile.

SUMMARY OF THE INVENTION

An object of the present invention is to provide a glove which is adapted to engage the throttle of the snowmobile.

A further object of the present invention is to provide a glove or mitten to a snowmobile operator which will securely engage the throttle in bumpy snow conditions.

Still another object of the present invention is to provide a warm article of clothing which increases the enjoyment of the snowmobile activity due to the lessening of muscle discomfort.

Another object of the present invention is to provide a method for engaging the throttle of the snowmobile which does not necessitate the use of the thumb to maintain the throttle in the accelerating position.

Broadly then the scope of the present invention includes a hand covering adapted to encompass a hand therein and having a hand member with thumb and digits extending therefrom to facilitate the operation of a vehicle. The hand covering comprises: a first covering portion and a second covering portion, the first covering portion adapted to encompass the thumb of the hand therein, and the second covering portion adapted to encompass the hand member and the digits; and an intersecting junction between the first covering and second covering.

The present invention also includes a hand covering adapted to enclose at least the thumb, index finger, second finger, ring finger, small finger, palm and rear portion of the hand of the wearer. The hand covering comprising a first and second complimentary member joined along edges with one edge being open. The first and second complimentary member having an exterior surface and an inner surface. The inner surface is adapted to engage with the hand of the wearer.

More specifically the invention include an inner thumb side edge connected with and located oppositely of the outer index finger side edge; the thumb side edge forming a short leg of a U shaped perimeter and the outer index side edge forming a long leg of a U shaped perimeter. This perimeter of the invention defining a U shaped gap between the thumb portion and the index finger portion of the glove. A strap bridges the gap and is operative to engage a throttle of a motor vehicle when the hand is placed within the hand covering in the operating position on the steering mechanism.

An exemplary embodiment includes a hand covering wherein the strap is formed of pleated material.

In another embodiment the strap has a mid point located above the axis plane that passes through the side edge of the thumb and index portion of the unworn glove. The thumb side edge and the outer index side edge have an axis plane which passes there through and the midpoint of the strap is not in that side edge axis plane. That is to say the strap is curve-linear.

A hand covering wherein the strap is formed of resilient material or plastic.

The invention can be formed as part of the glove and/or hand covering or it can be retrofited onto existing gloves. A retrofit strap can be removably attached to the hand covering.

In additional embodiments, the strap has a first side strap edge located proximate the thumb side edge and a second side strap edge located proximate the index side edge and an inner strap side edge located proximate the juncture of the thumb side edge and an index side edge. Additionally the strap has an outer strap side edge. The outer side edge can be formed in the shape of an inverted V. The outer side edge can be formed in the shape of an arch. The inner strap side edge can engage the juncture of the thumb and index side edge. Furthermore, the present invention includes the method of operating a throttle with a strap on a glove located between said thumb covering and said index covering.

DETAILED DESCRIPTION OF THE PREFERRED EMBODIMENT

The present invention is related to the operation of motor vehicles. Specifically, the invention is related to equipment used by a snowmobiler when operating a snowmobile. Particularly, the present invention relates to a glove adapted to engage the throttle of the snowmobile.

Figure 1:
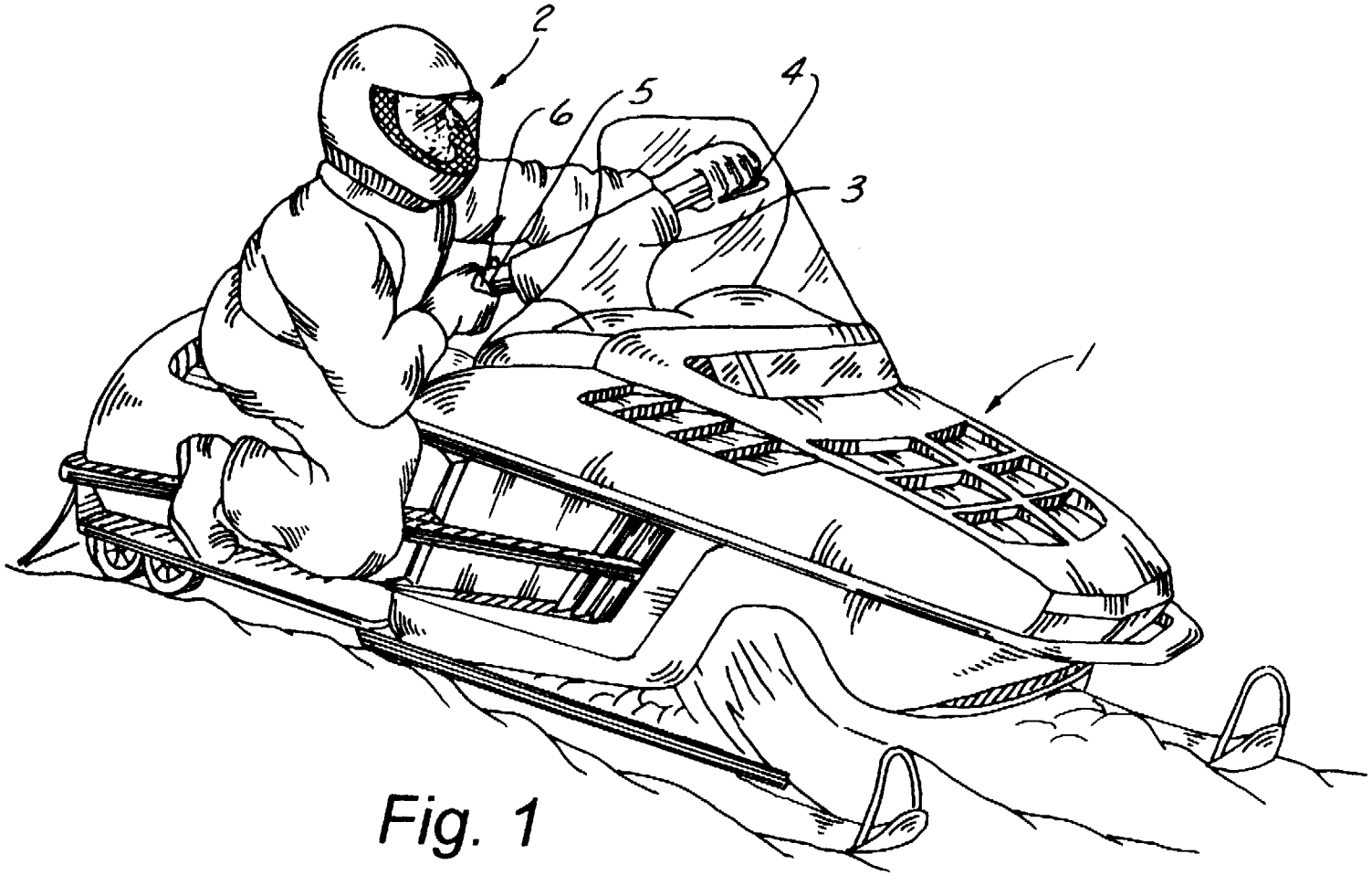
FIG. 1 FIG. 1 shows a perspective view of a snowmobile operator sitting on a snowmobile engaging the snowmobile throttle with an embodiment of the present invention.
Figure 2A:
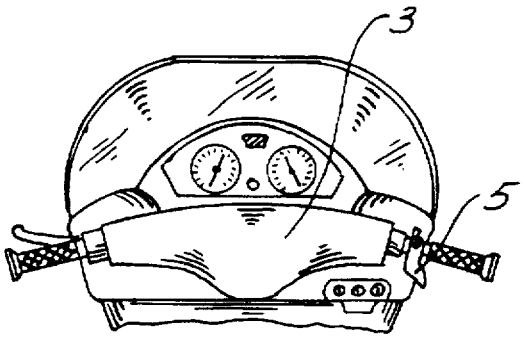
FIG. 2*a* FIG. 2*a* shows a planar view from the rear of the snowmobile of the handlebars of a snowmobile with the outwardly projecting throttle in position one.
Figure 2B:
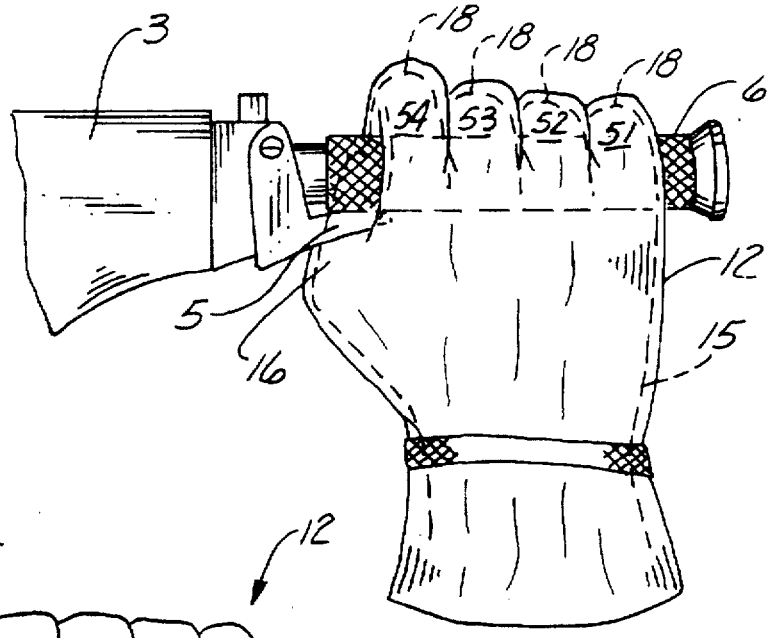
FIG. 2*b* FIG. 2*b* shows rear planar view of the handlebars of a snowmobile with a depressed throttle lever and shown in phantom a gloved hand engaging the throttle in the accelerating position.
Figure 2C:
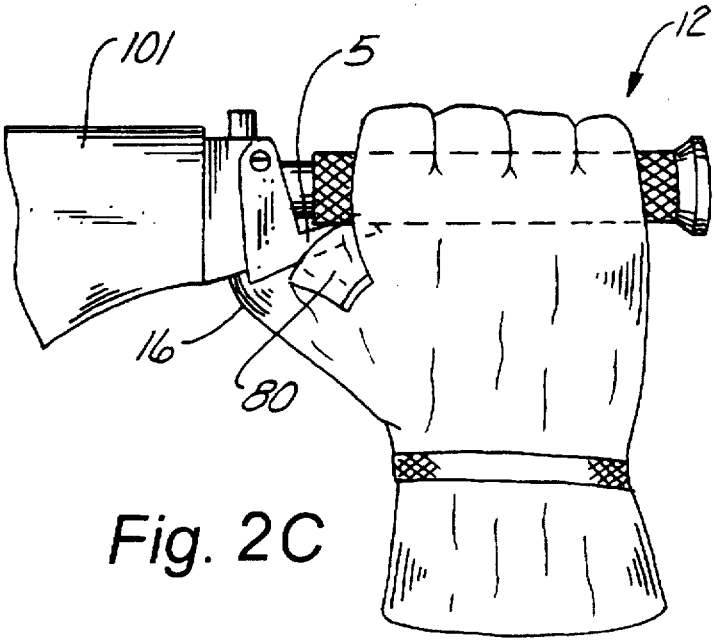
FIG. 2*c* FIG. 2*c* shows a rear planar view of the handle bars of a snowmobile with an embodiment of the present invention, depressing the throttle inwardly in the accelerating position.
Figure 3A:
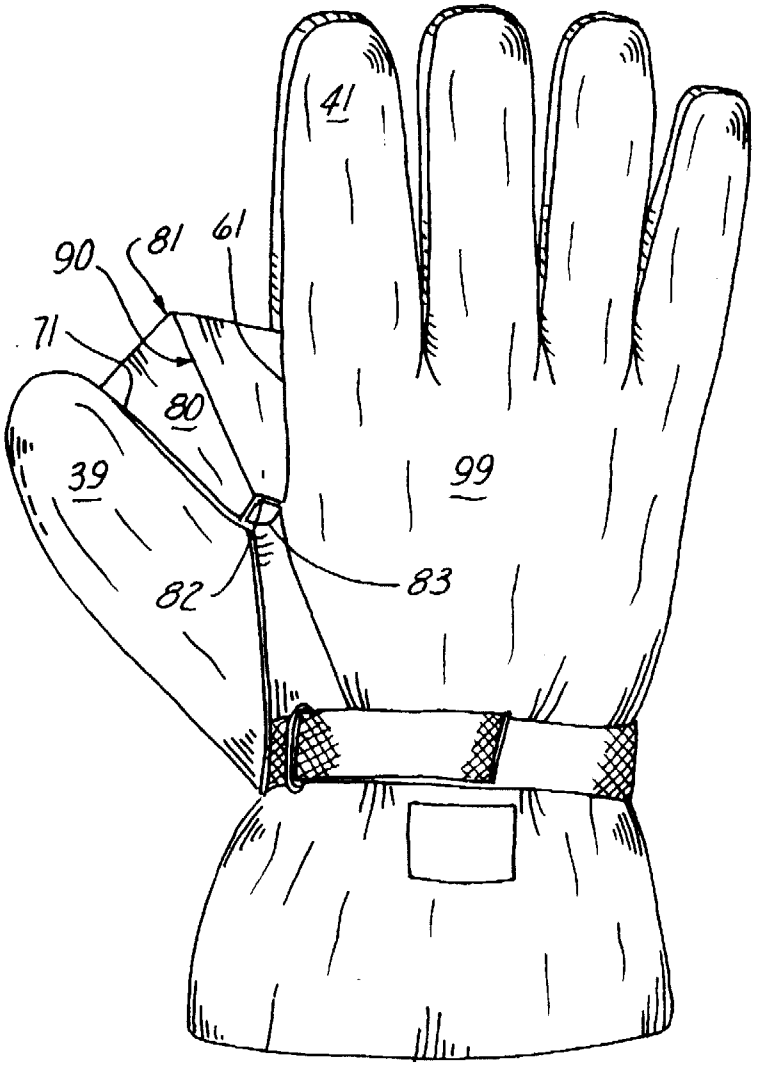
FIG. 3*a* FIG. 3*a* shows a top planar view of an embodiment of the present invention where the present invention includes a crease in the strap such that the material bends.
Figure 3:
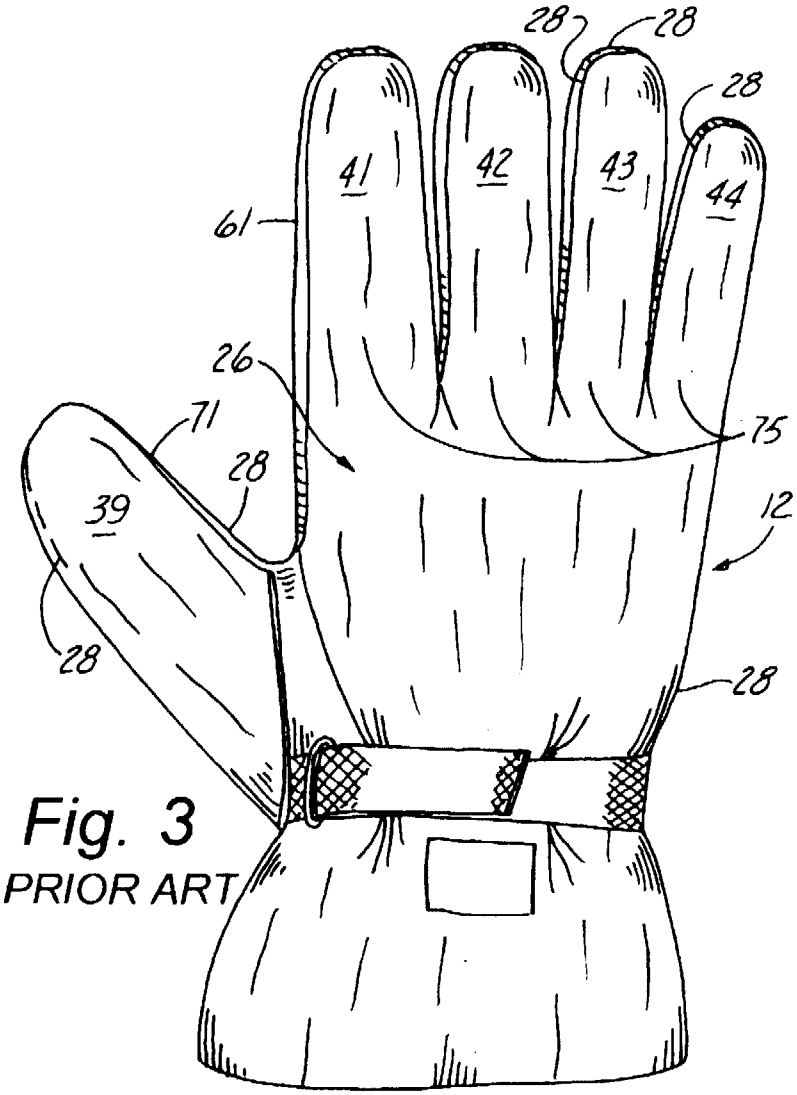
Fig. 3 PRIOR ART
FIG. 3 FIG. 3 shows a top planar view of a glove which can be employed for snowmobiling.

Broadly then, the present invention depicted in operation in FIGS. 1 through 3 includes a glove having a first portion defining a thumb receiving area and a second portion and having a throttle strap that interconnects the first portion of the glove and the second portion of the glove to form a strap which is adapted to engage the throttle lever on a steering mechanism of a motor vehicle.

FIG. 1 shows a perspective view of a snowmobile (1) being operated by a snowmobiler (2). The snowmobiler (2) is controlling the steering mechanism (3) with his right and left hands. The left hand controls the breaking mechanism and assists with directional control of the vehicle. The right hand assists with directional control of the vehicle, and controls the throttle (5) and thus the rate of acceleration of the snowmobile (1).

In this figure the throttle (5) of the snowmobile (1) is in the accelerating position. In the accelerating position the throttle (5) is depressed toward the hand grip (6) by the operator.

FIG. 2*a* shows the steering mechanism (3) when the throttle (5) is in the idling position. In the idling or off position the throttle (5) projects angularly outward from the steering mechanism (3).

FIG. 2*b* shows the steering mechanism (3) when the throttle (5) is in the accelerating position. The figure shows the hand (15) and digits (18) of the vehicle operator in phantom within a glove (12). To accelerate the snowmobile, the operator places his hand (15) on the hand grip (6) and wraps his or her's four digits (18) around the grip (6). As is clearly shown in FIG. 2*b* a hand (15) having an index finger (54), middle finger (53), ring finger (52) and little finger (51), shown in phantom in the glove (12), securely encircles the handgrip (6). The thumb (16) is used to depress the throttle (5) downward toward the handgrip (6) in the accelerating position. The use of the thumb (16) to operate the throttle (5) is often slightly uncomfortable and awkward. This slight discomfort often increases to the level of painful discomfort after a day of depressing the throttle into the accelerating position.

FIG. 2*c* show an exemplary embodiment of the present invention in use. The vehicle operator is no longer required to extend the thumb (16) upward from the clasped fingers onto the throttle (5); instead the throttle strap (80) that extends between the first portion of the glove, the thumb portion, and the second portion of the glove (12) or mitten, the finger or digit portion, engages the throttle (5). The hand can be adjusted on the handle bar (101) to force the throttle strap (80) downward across the throttle (5). This in turn depresses the throttle (5) into the accelerating position as shown in FIG. 2*c*.

FIG. 3 show a top planar top view of a glove such as the type used to operate vehicles. The glove (12) has a top glove portion (26) with an outer top glove perimeter (28) which is intersected at an intersecting junction (24) with the outer bottom glove perimeter (30). The glove (12) is adapted for a hand member and a thumb and digits. The digit covers (75) include the small finger cover (44), the ring finger cover (43), the middle finger cover (42) and the index finger cover (41). The index finger cover (41) has an outer finger side edge (61) which extends downward toward the thumb covering (39). The inner thumb side edge (71) of the thumb covering (39) forms the U shaped outer boundary between the index finger covering (44) and the thumb covering (39).

In FIG. 3*a* an exemplary embodiment of the present invention is shown. The U shaped outer boundary of the index finger covering (41) and the thumb covering (39) is interconnected by a throttle strap (80). The strap (80) has a thumb side edge (71) and a digit side edge (61). This embodiment of the throttle strap (80) has an outer strap edge (81), located opposite of the inner strap edge (82) which is proximate the midpoint (83) of the U shaped outer boundary. The throttle strap (80) can be formed of a variety of materials including but not limited to plastic, cloth, or rubber. In this embodiment of the present invention the material is preferably of a flexible, slightly resilient material. The throttle strap (80) of the present invention has a crease (90) approximately midway between the thumb inner side edge (71) and the index finger outer side edge (61). This crease (90) raises the throttle strap (80) slightly above the top glove surface (99). The raised strap (80) permits the vehicle operator to position the throttle strap (80) on the throttle of the vehicle. The throttle strap (80) when in operation is placed on the throttle in the closed position. The operator places the fingers and thumb around the handle grip and the strap over the throttle so that the throttle is engaged.

Figure 3C:
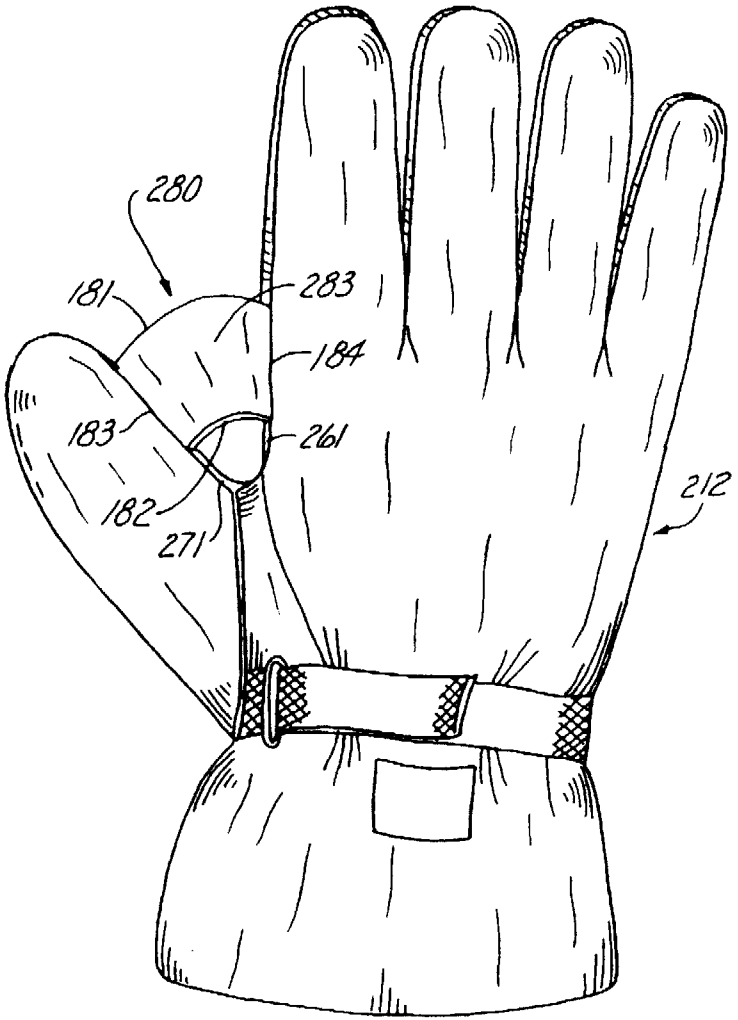
FIG. 3*c* FIG. 3*c* shows a top planar view of an exemplary embodiment of the present invention including a bowed strap adapted to engage the throttle.
Figure 3B:
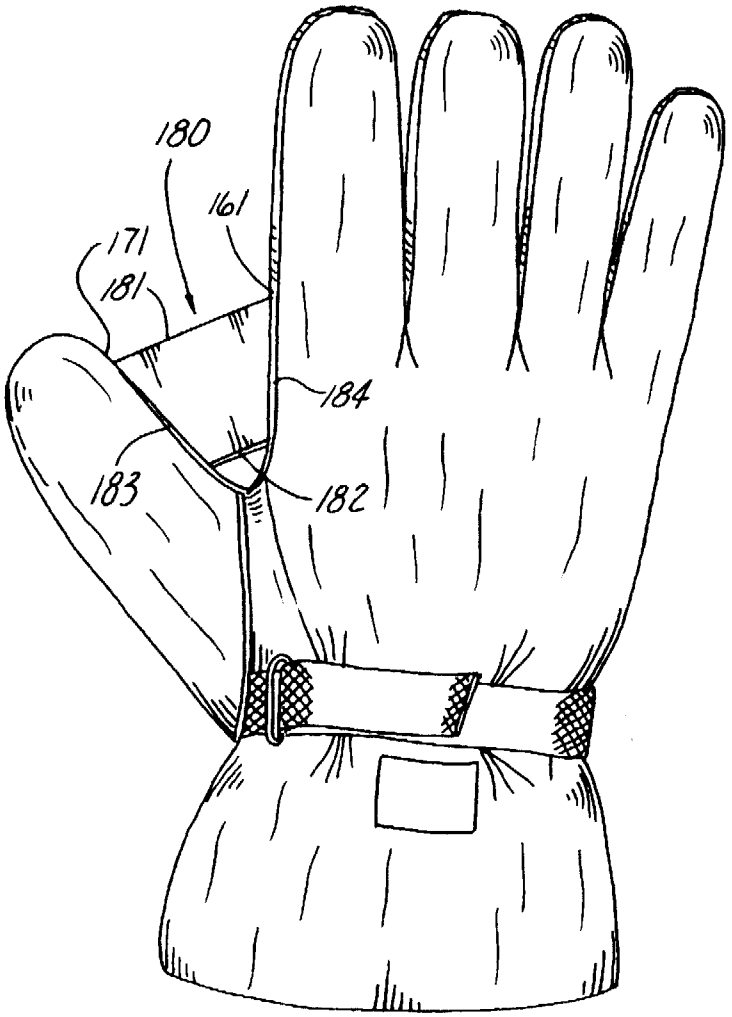
FIG. 3*b* FIG. 3*b* show a top planar view of an exemplary embodiment of the present invention including a bowed strap adapted to engage the throttle.
Figure 3D:
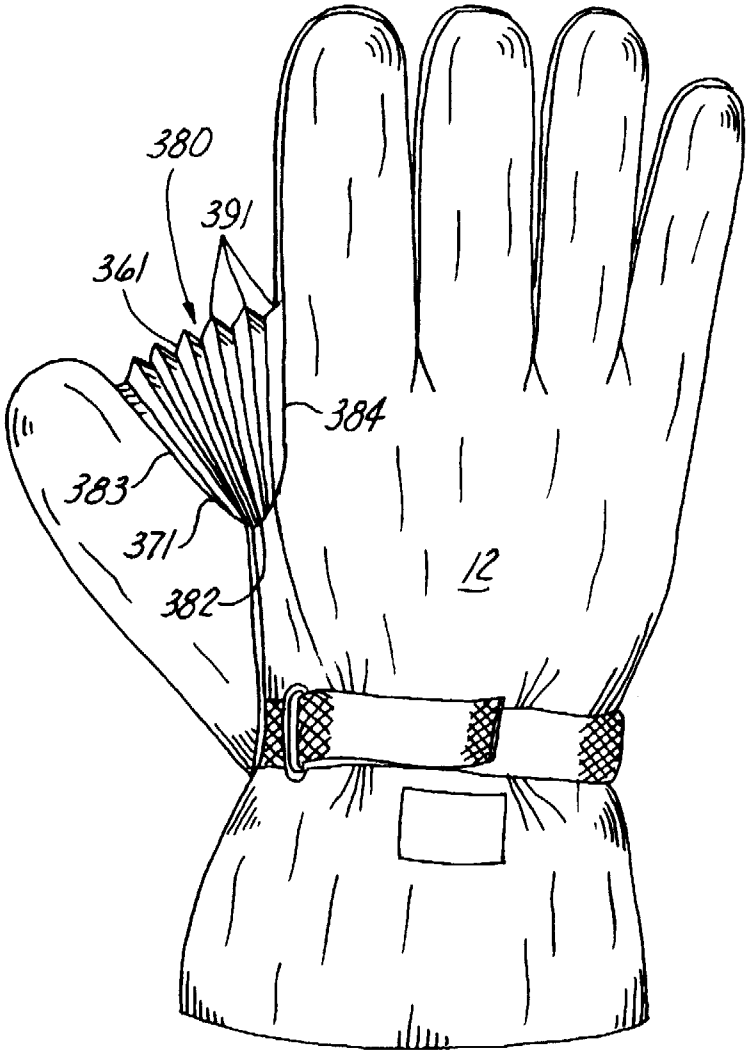
FIG. 3*d* FIG. 3*d* shows a top planar view of an exemplary embodiment of the present invention including a pleated strap adapted to conform and adapt to the throttle.

FIGS. 3*b* through 3*d* each show a strap (180). Each of these straps (180) has an outer strap edge (181) located opposite of the inner strap edge (182) which is positioned proximate the lower side of the U shaped outer boundary.

Each of the straps (180) has a thumb side strap edge (183) and an index side strap edge (184). The thumb strap side edge (183) is interconnected to the thumb covering inner edge (171). Similarly the index side strap edge (184) is interconnected to the digit covering outer edge (161).

FIG. 3*b* shows an exemplary embodiment of the present invention formed of a flexible elastic material. This flexible material permits the operator of the vehicle less restricted movement of the thumb relative to the digits when the hand is in the glove.

FIG. 3*c* shows another exemplary edit of the present invention. In this embodiment the mid point (283) of the throttle strap (280) is raised above the thumb side strap edge (271) and the index side strap edge (261) when the glove does not have a hand inserted therein. The throttle strap (280) is formed in an arch shaped resiliently flexible structure which is adapted to conform to the shape of the throttle.

FIG. 3*d* shows a fourth exemplary embodiment of the present invention. The throttle strap (380) is interconnected to the bottom of the U shaped boundary. The throttle strap (380) is formed with multiple pleats (391) to permit flexibility of the thumb and digits within the glove. The pleated strap (380) is adapted to engage the throttle of the vehicle while the hand enclosed in the glove (12) comfortably grips the handle of the steering mechanism.

Figure 4:
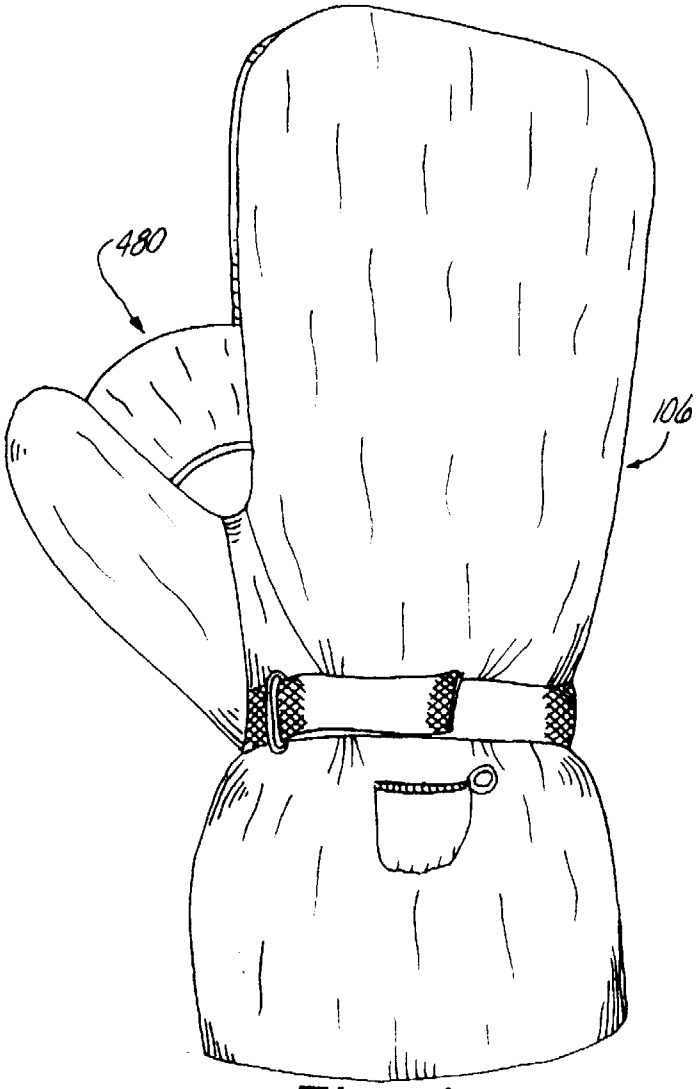
FIG. 4 FIG. 4 shows a top planar view of an embodiment of the present invention showing the present invention formed as a glove versus a mitten.

FIG. 4 shows the curvelinear strap (480) formed on a hand covering (106) without individual digits, i.e. a mitten. Both mittens (106) and gloves (12) are equally adaptable to the present invention. Although not shown, the various embodiments shown in the previous FIGS. 3*a* through 3*d* could be placed on a mitten (106) or a glove. Likewise the retrofit throttle strap (580), in FIG. 5 is made to retrofit onto a mitten (106) instead of a glove (shown in phantom).

Figure 5:
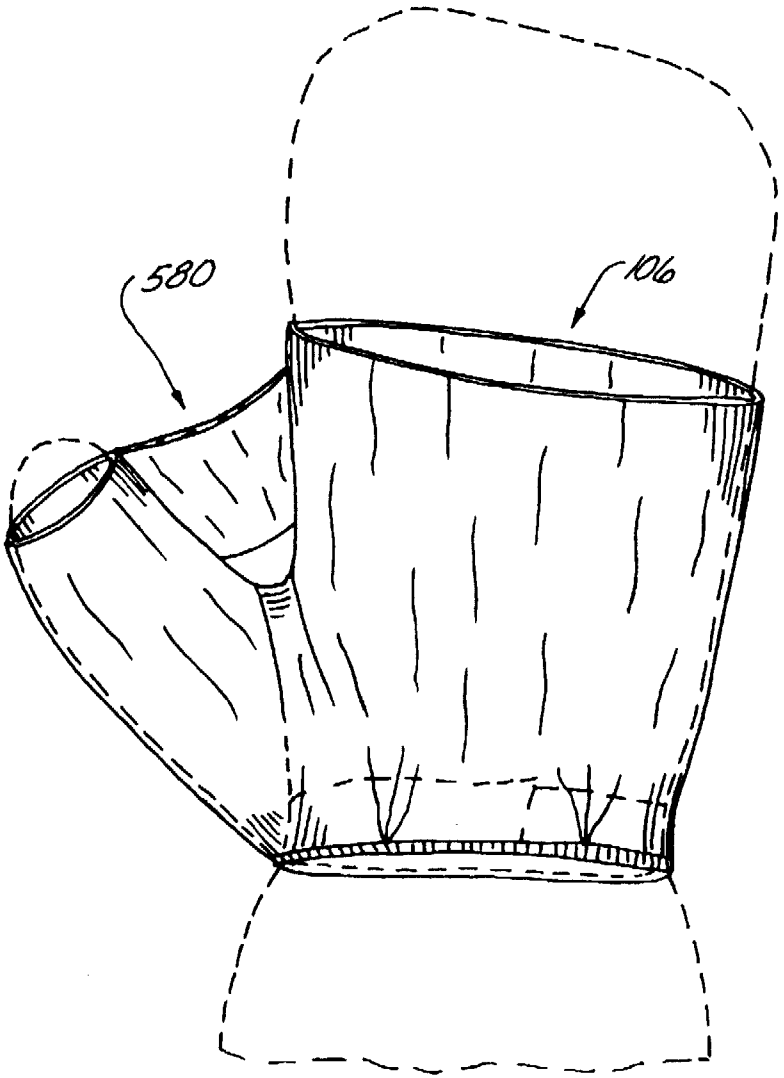
FIG. 5 FIG. 5 shows the top planar view of a retrofit embodiment of the present invention adapted to be attached or detached from the glove such as shown in FIG. 3.

FIG. 5 clearly shows an alternative invention which can be retrofited to make a standard glove (12) adapted to engage the throttle with the throttle strap (580). The embodiment in FIG. 5 is preferably made of flexible and slightly resilient material. The retrofit throttle strap (580) is adapted to be slid over a mitten or a glove when the wearer of the hand covering desires to operate the vehicle. When the wearer of the hand covering is not operating a vehicle (8) the present invention can be removed.

Figure 6:
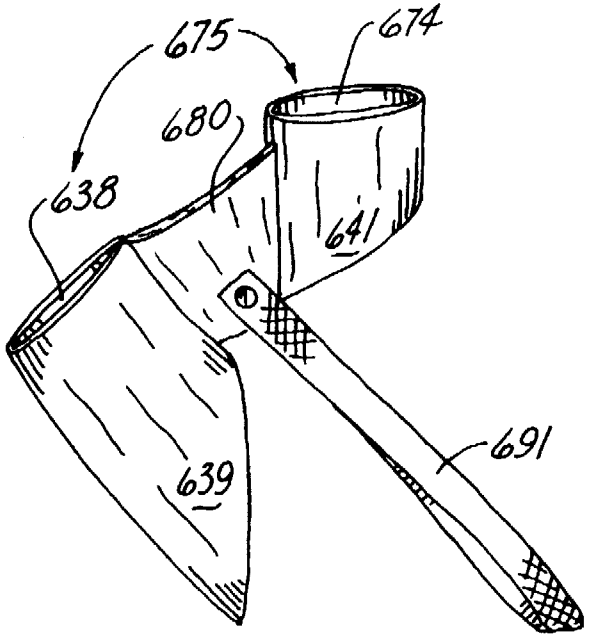
FIG. 6 FIG. 6 shows the top planar view of a retrofit embodiment of the present invention; and FIG. 7

FIG. 6 shows another alternative embodiment of the present invention. In this embodiment the invention has a belt (691) which encircles the palm portion (15) of the glove and is removably attachable to the digit coverings and thumb holster (639). The glove index finger (641) is adapted to be inserted upwardly from the belt (691) into the digit holster (675) whereby the outer portion of the index glove finger and the glove thumb project from the two holsters (638), (674). Mounted and interconnected to the side index of both holsters is a strap (680) that bridges the gap there between for engagement with the throttle.

Figure 7:
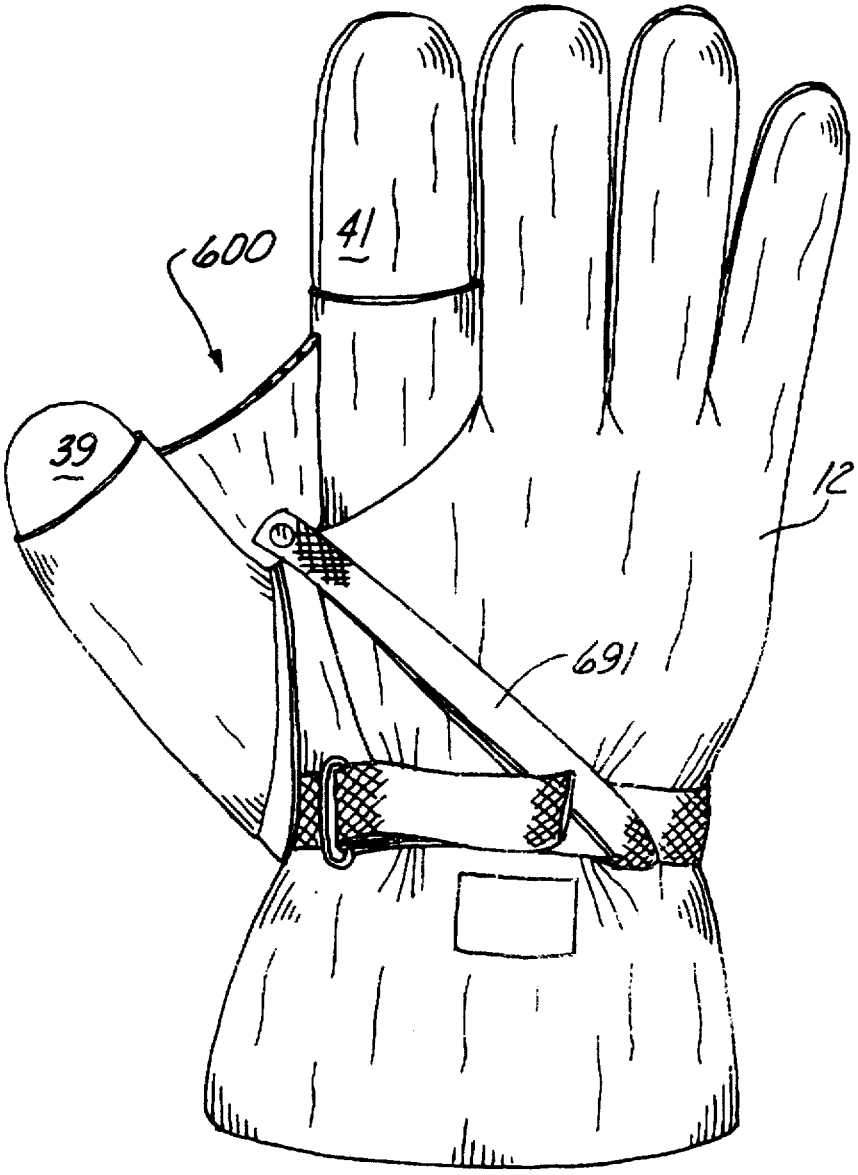
FIG. 7 shows the retrofit diet of FIG. 6 mounted on a glove.

FIG. 7 shows the embodiment of FIG. 6 retrofit onto a glove (12). Clearly, the embodiment is removable by releasing the encircling belt (691) and sliding the device (600) upward off the glove (12). This permits the operator unrestricted use of the glove (12), specifically the thumb covering (39) and index finger covering (41) when not operating a vehicle. Additionally, when the present invention is retrofitted onto the glove (12), the glove wearer can operate a throttle with little to no stress on the thumb while retaining a natural and relaxing grip on the handle bar.

I claim:

1. A method for operating a vehicle having a throttle, the steps comprising:

providing a hand covering adapted to encompass a hand therein, said hand covering including a forefinger and the thumb portion and having a strap interconnecting said forefinger and said thumb portion of said hand covering;

positioning the hand covering on a hand; and engaging said throttle of the vehicle with the strap of said hand covering.

2. A method according to claim one wherein said strap is formed of pleated material.

3. A method according to claim one wherein said strap is formed of resilient material.

4. A method according to claim one wherein said strap is formed of plastic.

5. A method according to claim one wherein said strap is removably attached to said hand covering.

6. A method for operating a snowmobile having a throttle, the steps comprising:

providing an improved hand covering configured as a snowmobile glove and adapted to enclose at least the thumb, index finger, second finger, ring finger and small finger, palm and rear portion of the hand of the wearer, said hand covering having a first and second complimentary member, each of said complimentary members being joined one to the other member along side edges one of the side edges being open, said first and second complimentary member having an exterior surface and an inner surface adapted to engage with said hand of said wearer, said first and second complimentary member having an inner thumb side edge connected with and located oppositely of an outer index finger side edge, said thumb side edge forming a short leg of a u-shaped perimeter and said outer index finger side edge forming a long leg of a u-shaped perimeter, said perimeter defining a u-shaped gap, and including a strap having a first and second side edge, said first side strap edge proximate said thumb side edge and first strap edge being no longer in length than the short leg of the u-shaped perimeter and said second side strap edge being no longer in length than the short leg of the u-shaped perimeter, said second side strap edge proximate said outer index finger side edge wherein said strap bridges said u-shaped gap;

wearing said hand covering on a hand; and, engaging said throttle of the snowmobile with the strap of said hand covering.

7. A method according to claim 6 wherein said strap has a midpoint between said thumb side edge and said outer index finger side edge wherein said thumb side edge and said outer index side edge forms an axis which passes therethrough and said midpoint of said strap is not in that side edge axis.

8. A method according to claim 6 wherein said strap is curvilinear.

9. A method according to claim two wherein said strap has an inner side edge located proximate a juncture of said thumb side edge and a second side edge and an outer side edge.

10. A method according the claim nine wherein said outer side edge is formed in the shape of an inverted V.

11. A method according to claim nine wherein said outer side edge is formed in the shape of an arch.

12. A method according the claim nine wherein said inner side edge engages said juncture.

13. A method for operating a vehicle having a throttle, the steps comprising:

providing a glove;

providing a retrofit throttle strap configured to mateably engage said glove between the thumb and index finger;

positioning the hand covering on a hand and the throttle strap on said hand covering; and, engaging said throttle of the snowmobile with the retrofit throttle strap.

* * * * *